US006598551B2

(12) United States Patent
Nakajima et al.

(10) Patent No.: US 6,598,551 B2
(45) Date of Patent: Jul. 29, 2003

(54) REAR GRIP STRUCTURE FOR A BOAT

(75) Inventors: Jun Nakajima, Saitama (JP); Takayoshi Miura, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/231,107

(22) Filed: Aug. 30, 2002

(65) Prior Publication Data

US 2003/0056706 A1 Mar. 27, 2003

(30) Foreign Application Priority Data

Sep. 6, 2001 (JP) ..... 2001-269856

(51) Int. Cl.[7] ..... B63B 35/73
(52) U.S. Cl. ..... 114/55.57
(58) Field of Search ..... 114/55.51, 55.5, 114/55.57, 363, 362

(56) References Cited

U.S. PATENT DOCUMENTS 5,964,172 A * 10/1999 Ikeda ..... 114/55.57
6,435,119 B1 * 8/2002 Pelletier et al. ..... 114/55.51

FOREIGN PATENT DOCUMENTS

JP 9-281132 10/1997

* cited by examiner

*Primary Examiner*—Ed Swinehart
(74) *Attorney, Agent, or Firm*—Birch, Stewart, Kolasch & Birch, LLP

(57) ABSTRACT

A rear grip structure for a small boat capable of discharging water which has entered the boat from between the hull side and the seat. The rear grip structure for a small boat has a structure in which an outer frame is formed into a hollow structure and is inclined upward. The outer frame 31 formed with the first eyelets at the lower portions on the left and the right and with the second eyelets at the portions higher than the first eyelets. This enables the outer frame to play the role of a drain trough, such that when water collects in the rear grip structure, it is taken into the hollow outer frame through the second eyelets. Thereafter, the water in the hollow frame flows down the incline of the hollow frame and is discharged through the first eyelets. The rear grip structure is mounted on the upper hull with a plurality of mounting bolts.

16 Claims, 11 Drawing Sheets

REAR GRIP STRUCTURE FOR A BOAT

CROSS-REFERENCE TO RELATED APPLICATION

The present application claims priority under 35 U.S.C. §119 to Japanese Patent Application No. 2001-269856, filed Sep. 6, 2001, the entire contents of which are hereby incorporated by reference.

BACKGROUND OF THE INVENTION

1. Field of the Invention

The present invention relates to a rear grip structure in which a rear grip is attached on the hull of a small boat and a seat is placed on the rear grip.

2. Description of Background Art

A jet propulsion boat is a vessel provided with a jet pump mounted at the rear portion of the hull. The engine drives the jet pump to propel the boat by drawing in water from the vessel bottom and splashing water in a rearward direction.

One example of such a jet propulsion boat is disclosed in JP-A-9-281132, entitled "SPEED SENSOR ARRANGEMENT STRUCTURE FOR A SMALL CRAFT". The jet propulsion boat in this publication will be described in detail while citing a part of FIG. 10 of this publication in the following figure.

FIG. 11 of this application is a cross sectional view showing a principal portion of the jet propulsion boat in the related art.

The jet propulsion boat 100 is constructed in such a manner that a shoulder 102*a* is formed along the outer periphery 102 of the rear portion of the deck 101, and a grab bar 103 is placed on the shoulder 102*a* and secured by a bolt 104. As such, the grab bar 103 is secured on the deck 101 and the bottom surface 107*a* of the rear seat 107 is placed on the loading base 106 at the inner side of the grab bar 103.

Since the grab bar 103 comprises an outer handhold portion 103*a* on the outer side, the occupant sitting on the rear seat 106 can maintain a stable posture on the boat by laying his/her hand thereon.

A gap 108 is formed between the grab bar 103 and the rear seat 107, and in addition, the gap 108 is in communication with the recess 109 formed between the grab bar 103 and the deck 101. Therefore, when seawater enters the boat from between the grab bar (hull side) 103 and the rear seat 107, the seawater tends to collect in the recess 109 formed by the grab bar 103 and the deck 101.

Since a bolt 104 for securing the grab bar 103 on the deck 101 is mounted in the recess 109, the bolt 104 may be soaked into seawater and thus corroded when seawater is pooled in the recess 109.

In order to prevent corrosion of the bolt 104, it is necessary to frequently remove the seawater collecting in the recess 109. Accordingly, maintenance requires substantial time and effort.

SUMMARY AND OBJECTS OF THE INVENTION

Accordingly, it is an object of the present invention to provide a rear grip structure for a small boat in which water which has entered between the hull side and the seat can be easily discharged.

In order to solve the problem, the present invention provides a small boat comprising an engine disposed in substantially center of a hull including an upper hull and a lower hull, an opening formed on the upper hull at the portion above the engine, a rear grip extending obliquely from the rear portion of the opening toward the upper rear mounted on the upper hull, and an elongated saddle-riding type seat placed over the opening and the rear grip. The rear grip plays the role of a drain trough in such a manner that the rear grip is formed into a hollow structure. Further, the rear grip is inclined upward and includes a first eyelet at the lower portion thereof and a second eyelet at the portion higher than the first eyelet. With this configuration, water collected on the rear grip is taken into the hollow portion of the rear grip via the second eyelet and then flows down trough the hollow portion and is drained through the first eyelet.

The hollow rear grip is inclined upward and the rear grip is formed with a first eyelet at the lower portion and with a second eyelet at the portion higher than the first hole as needed so that the rear grip plays the role of a drain trough.

As a consequence, even when water enters from between the rear grip and the saddle-riding type seat, water is taken into the hollow rear grip through the second eyelet and then is discharged outside through the first eyelet.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Referring now to the attached drawings, an embodiment of the present invention will be described below. A jet propulsion boat will be taken as an example for description of a small boat.

Figure 1:
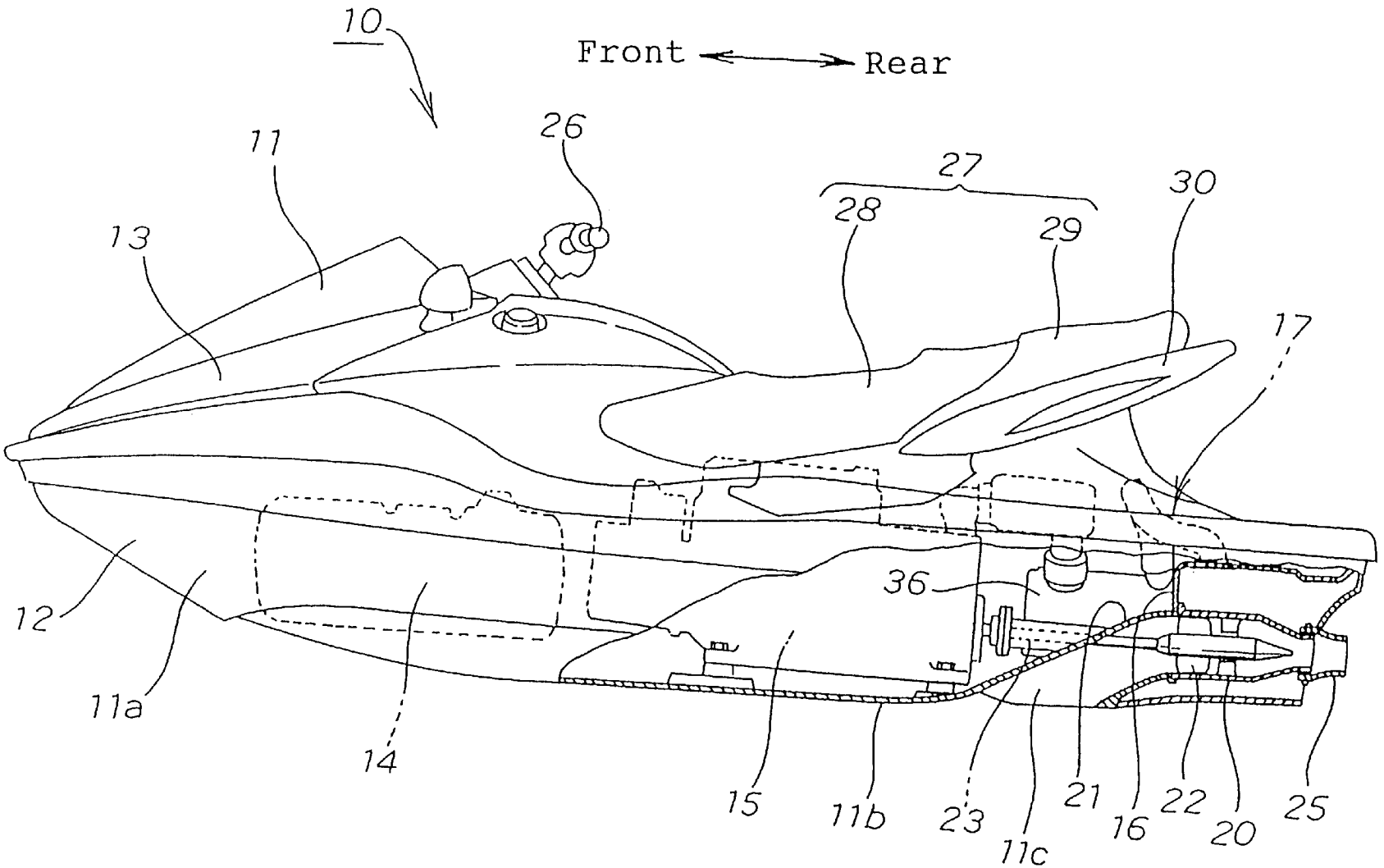
FIG. 1 is a side view of a small boat having a rear grip structure according to the present invention.

FIG. 1 is a side view of a small boat comprising a rear grip structure according to the present invention.

The jet propulsion boat 10 comprises a hull 11 including a lower hull 12 and a upper hull 13, a fuel tank 14 mounted at the front portion 11*a* of the hull 11, an engine 15 provided at the substantially center of the hull 11, a pump chamber 16 provided to the back of the engine 15, and a jet pump 20 provided in the pump chamber 16. Further, an exhaust pipe 17 is attached to the engine 15 on the air intake side and to the pump chamber 16 on the exhaust side, a steering handle 26 is disposed above the fuel tank 14, an opening (not shown) is formed on the upper hull 13 at the portion above the engine 15, a rear grip structure 30 extending from the rear portion of the opening obliquely toward the upper rear is attached oil the upper hull 13, an elongated saddle-riding type seat 27 is placed over the opening and the rear grip structure 30.

The saddle-riding type seat 27 comprises a front seat 28 and a rear seat 29.

The jet pump 20 comprises a housing 21 extending rearward from the inlet port 11*c* of the vessel bottom 11*b*, an impeller 22 rotatably mounted in the housing 21 and connected to the drive shaft 23 of the engine 15.

With the jet pump 20, water drawn in from the inlet port 11*c* of the vessel bottom 11*b* is splashed via the rear end opening of the housing 21 from the steering nozzle 25 rearwardly of the hull 11 by driving the engine 15 and rotating the impeller 22.

The steering nozzle 25 is a member mounted at the rear end of the housing 21 so as to be capable of swinging freely in the lateral direction. The steering nozzle 25 is a steering nozzle for controlling the steering direction of the hull 11 by operating and swinging the steering handle 26 in the lateral direction.

The vessel 10 is propelled by supplying fuel from the fuel tank 14 to the engine 15 to drive the engine 15, transmitting a driving force of the engine 15 to the impeller 22 via the drive shaft 23, drawing in water from the inlet port 11*c* of the vessel bottom 11*b* by rotating the impeller 22, and splashing water through the rear end of the housing 21 from the steering nozzle 25.

Figure 2:
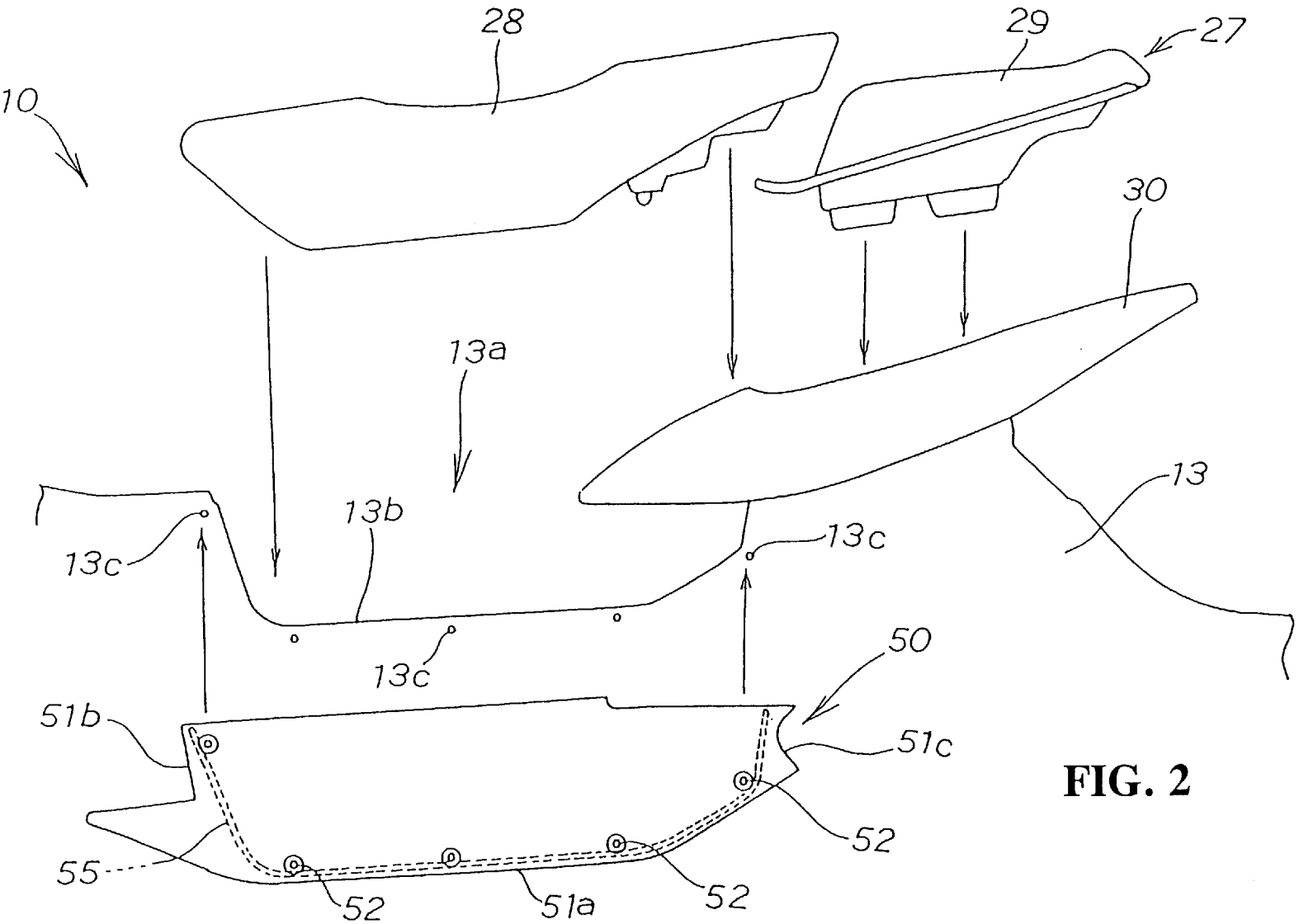
FIG. 2 is an exploded side view of a principal portion of a small boat having a rear grip structure according to the present invention.

FIG. 2 is an exploded side view of a principal portion of the small boat having a rear grip structure according to the present invention, showing a state in which the front seat 28 of the saddle-riding type seat 27 is removed from the opening 13*a* of the upper hull 13, and the left and the right side covers 50 (only the one on the left side is shown) are removed from the left and the right sides of the opening 13*a* of the upper hull 13, and the rear seat 29 of the saddle-riding type seat 27 is removed from the rear grip structure 30.

The left side cover 50 is a plate in the substantially rectangular shape, and is a member comprising a sealing member 55 disposed along the lower side 51*a* and the front and rear sides 51*b*, 51*c*, and mounting holes 52 . . . for inserting bolts 56 . . . (shown in FIG. 3) along the sealing member 55.

These mounting holes 52 . . . is adapted to be coaxial with bolt mounting holes 13*c* formed along the peripheral edge 13*b* of the opening 13*a* when the opening 13*a* of the upper hull 13 is covered by the left side cover 50.

Since the right side cover and the left side cover 50 are laterally symmetrical member, only the left side cover 50 will be described and description of the right side cover will be omitted.

Figure 3:
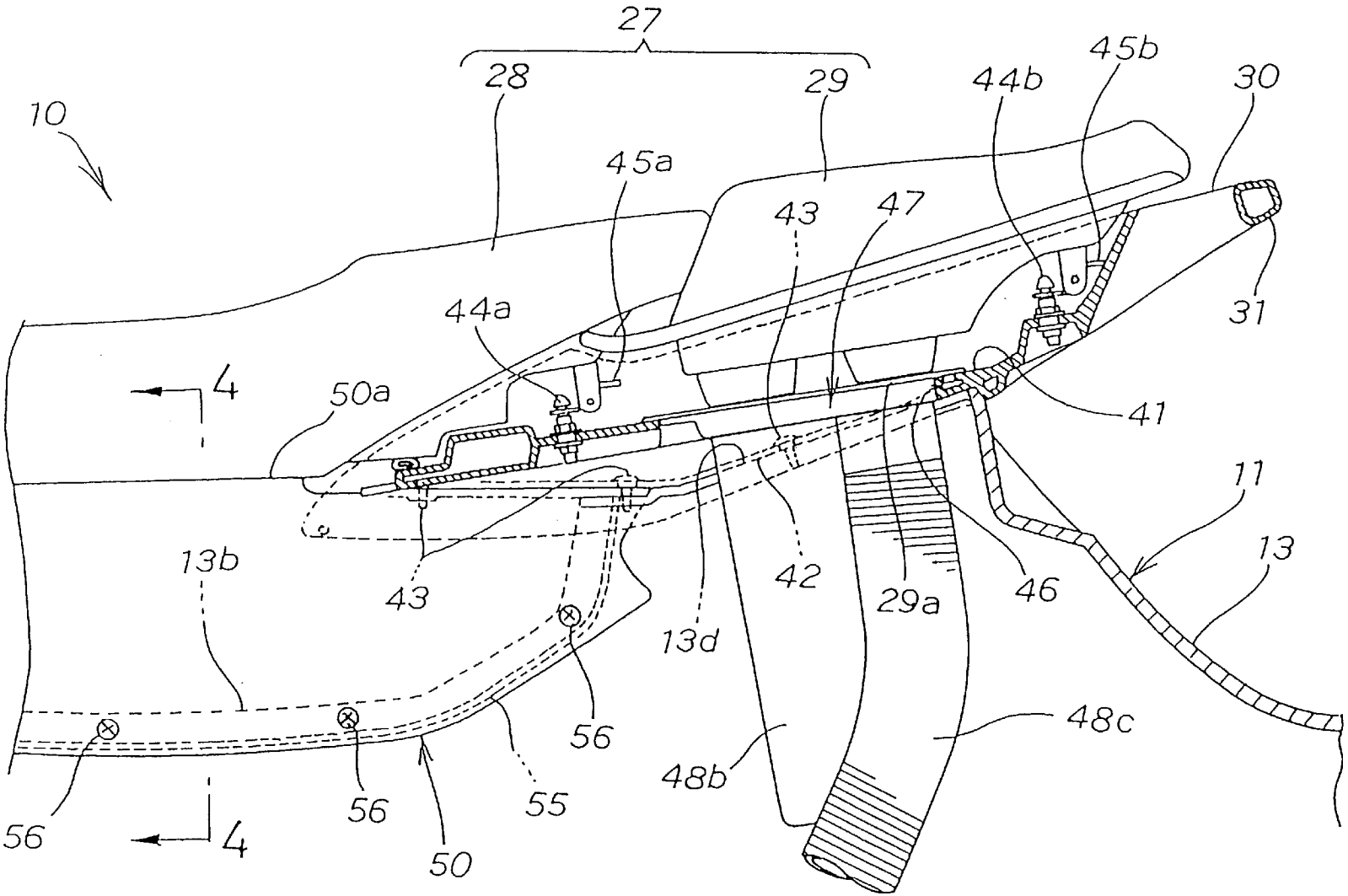
FIG. 3 is a side view showing a principal portion of a small boat having a rear grip structure according to the present invention.

FIG. 3 is a side view showing a principal portion of the small boat having a rear grip structure according to the present invention, showing a state in which the left and the right side covers 50 (only the one on the left side is shown) are arranged so as to close the left and the right sides of the opening 13*a* (shown in FIG. 2) of the upper hull 13, the left and the right side covers 50 are attached on the upper hull 13 with bolts 56 . . . The front seat 28 of the saddle-riding type seat 27 is attached on the upper portion 50*a* of the left and the right side covers 50 with bolts, and the rear seat 29 of the saddle-riding type seat 27 is attached on the rear grip structure 30.

The opening 13*a* of the upper hull 13 call be closed by mounting the left side cover 50 on the upper hull 13 with bolts 56 . . . In this case, since the sealing member 55 of the left side cover 50 can be arranged along the peripheral edge 13*b* of the opening 13*a*, a gap between the left side cover 50 and the upper hull 13 can be sealed by the sealing member 55 reliably.

The rear grip structure 30 is a member inclined upward toward the rear of the hull 11 constructed in such a manner that the outer frame is formed of a hollow outer frame 31, a recess 41 is formed inside the outer frame 31, the bottom surface 42 of the recess 41 is placed on the upper end 13*d* of the upper hull 13, and the upper hull 13 is fixed by the mounting bolt 43.

A front and a rear locking members 44*a* are mounted on the rear grip structure 30 in front and behind of the recess 41. The front seat 28 of the saddle-riding type seat 27 can be locked in the position of use by locking a front latch 45*a* to the front locking member 44*a*, and the rear seat 29 of the saddle-riding type seat 27 can be locked by mounting the rear locking member 44*b* at the rear end of the recess 41 and then locking a rear latch 45*b* to the rear locking member 44*b*.

The recess 41 of the rear grip structure 30 is provided with an opening 46. A rear tray 47 is inserted from above into the opening 46, and the peripheral edge of the rear tray 47 is placed on the peripheral edge of the opening 46, and then the bottom surface 29*a* of the rear seat 29 of the saddle-riding type seat 27 is placed on the rear tray 47. As a consequence, the rear tray 47 call remain stationary.

The rear tray 47 comprises a storage box 48*a* for storing the tools, a storage box 48*b* for storing the fire extinguisher, and an air vent 48*c* for ventilating the interior of the hull 11.

Figure 4:
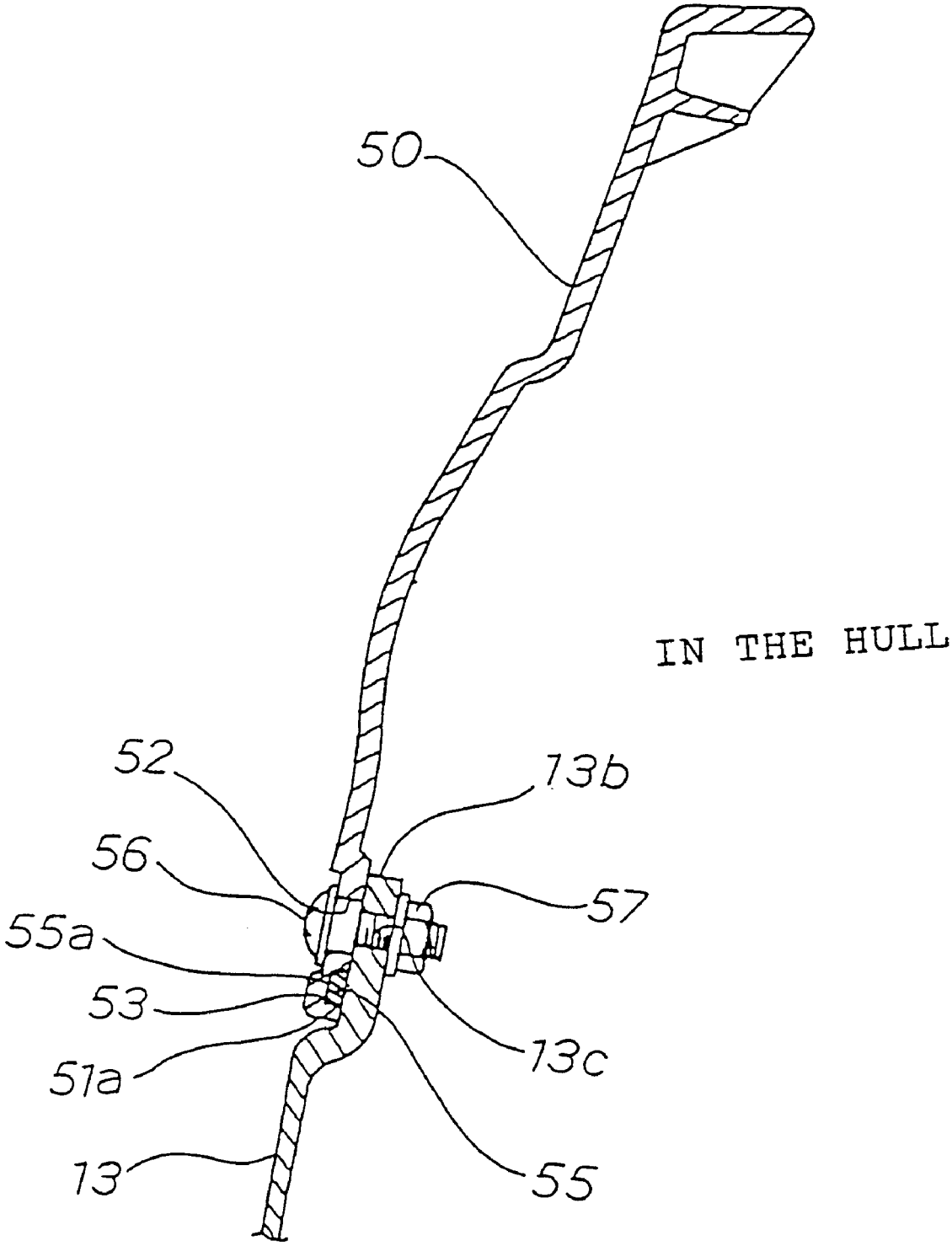
FIG. 4 is a cross sectional view taken along the line 4—4 in FIG. 3.

FIG. 4 is a cross sectional view taken along the line 4—4 in FIG. 3, showing a state in which the left side cover 50 is attached on the upper hull 13 by placing the peripheral edge (lower side 51*a*) of the left side cover 50 on top of the peripheral edge 13*b* of the upper hull 13, aligning the mounting hole 52 of the left side cover 50 with the bolt mounting hole 13*c* on the upper hull 13, inserting the bolt 56 from outside of the hull 11 into the mounting hole 52 and the bolt mounting hole 13*c*, and screwing the nut 57 on the bolt 56.

A seal-mounting groove 53 is formed on the peripheral edge (lower edge 51*a*, front and rear edges 51*b*, 51*c* (shown in FIG. 2)) of the left side cover 50, and the sealing member 55 is mounted on the seal-mounting groove 53. The sealing member 55 is provided with double-faced adhesive tape 55*a* on one side, and the sealing member 55 is adhered on the bottom surface of the seal-mounting groove 53.

This ensures that the sealing member 55 is mounted in the seal-mounting groove 53 of the left side cover 50, so that the left side cover 50 can easily be mounted on the upper hull 13.

Since the sealing member 55 can be pressed against the peripheral edge 13*b* of the upper hull 13 by mounting the side cover 50 on the upper hull 13, the gap between the left side cover 50 and the upper hull 13 can be scaled by the sealing member 55 reliably. Therefore it can prevent seawater or the like from entering into the hull 11.

One example of the sealing member 55 is EPTSEALIER No.681 (brand name) manufactured by Nitto Denko Corporation. However, other sealing members may be used.

Figure 5:
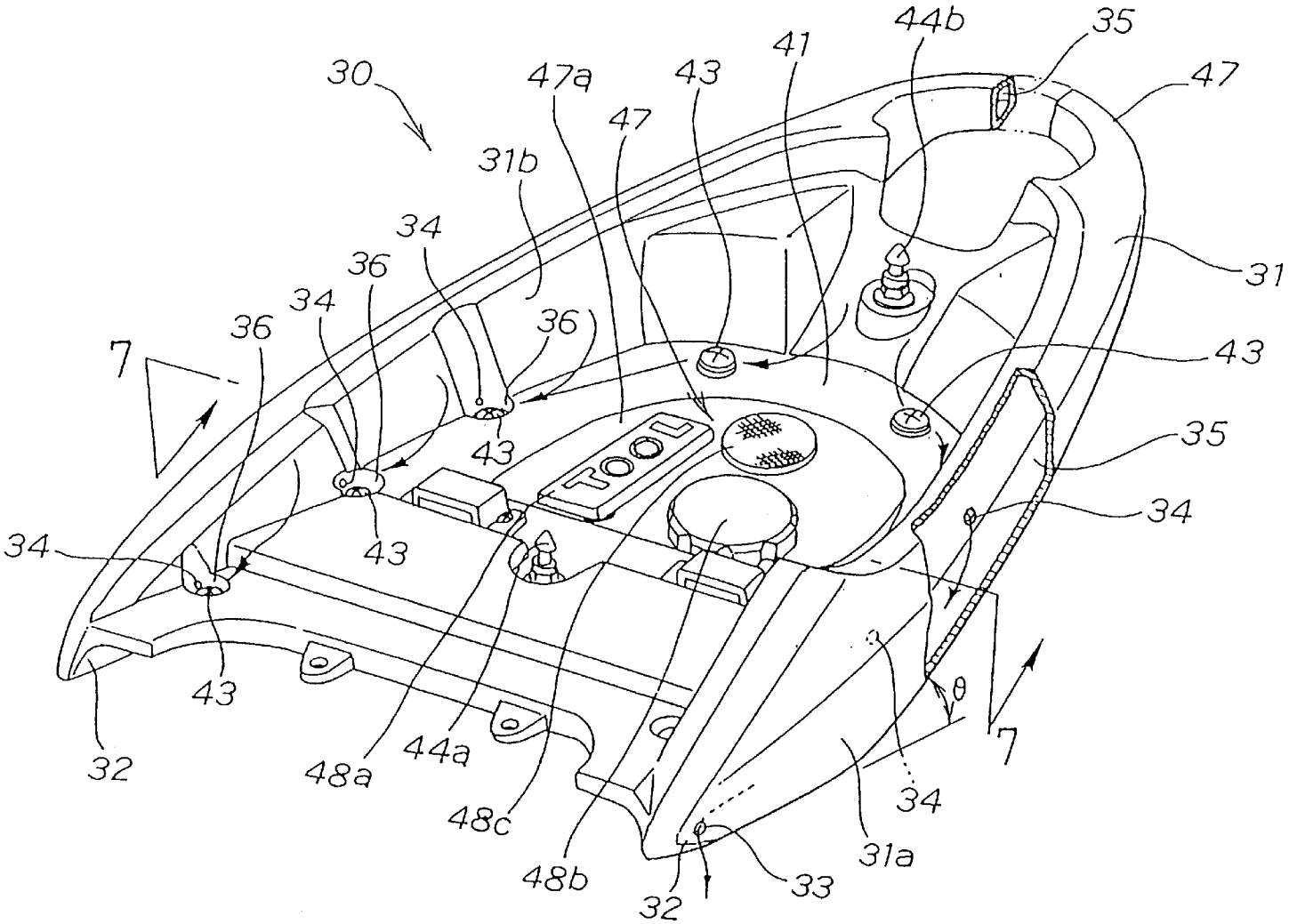
FIG. 5 is a perspective view showing a rear grip structure of a small boat according to the present invention.

FIG. 5 is a perspective view of the rear grip structure for a small boat according to the present invention.

The rear grip structure 30 for a small boat is a structure in which the outer frame (rear grip) 31 is formed into a hollow structure and is inclined upward, and the outer frame 31 is formed with the first eyelets 33, 33 (the one on the far side is not shown) at the lower portions 32, 32 on the left and the right of the outer frame 31 and with the second eyelets 34 . . . at the portions higher than the first eyelets 33, 33. The outer frame 31 plays the role of a drain trough in such a manner that the water collecting in the rear grip structure 30 (for example, seawater) is taken into the hollow outer frame 31 through a the second eyelets 34 . . . . From there the water flows down in the outer frame 31 is discharged through the first eyelets 33, 33. The rear grip structure 30 is mounted on the upper hull 13 (See FIG. 3) with a mounting bolt 43.

The outer frame 31 is a member formed of a frame body provided with a hollow portion 35 in the substantially U-shape, inclined upward toward the rear of the hull 11 by an angle θ, and formed with the first eyelets 33 at the lower portions 32, 32 and with the second eyelets 34 . . . at the portions higher than the first eyelets 33.

The first eyelets 33, 33 are discharge holes in communication with the hollow portion 35 of the outer frame 31 by being formed respectively on the outer wall 31*a* (only the one on the left side is shown) at the front end (that is, at the lower portions 32, 32) of the outer frame 31 on the left and the right sides.

The second eyelets 34 . . . are holes in communication with the hollow portion 35 of the outer frame 31 by being formed from the bottoms of the counterbores 36 . . . that are formed for attaching the mounting bolt 43 through into the inner surface 31*b* of the outer frame 31.

In the unlikely event that seawater enters into the counterbores 36 . . . as shown by the arrow, since the first eyelets 33, 33 and the second eyelets 34 . . . are formed on the rear grip structure 30 as described above, seawater so entering flows through the second eyelets 34 . . . and into the hollow portion 35 of the outer frame 31.

Once in the hollow portion 35, the seawater flows through the hollow portion 35 to the lower portions 32, 32 of the outer frame 31, and then flows out from the outer frame 31 through the first eyelets 33, 33. Therefore, seawater is prevented from collecting in the counterbores 36 . . . As a consequence, seawater cannot collect in the recess 41 of the rear grip structure 30.

The rear tray 47 can be supported by the recess 41 of the rear grip structure 30 by inserting the rear tray 47 from above into the opening 46 (shown in FIG. 3) of the recess 41 of the rear grip structure 30 and placing the peripheral edge 47*a* of the rear tray 47 on the peripheral edge of the opening 46.

Figure 6:
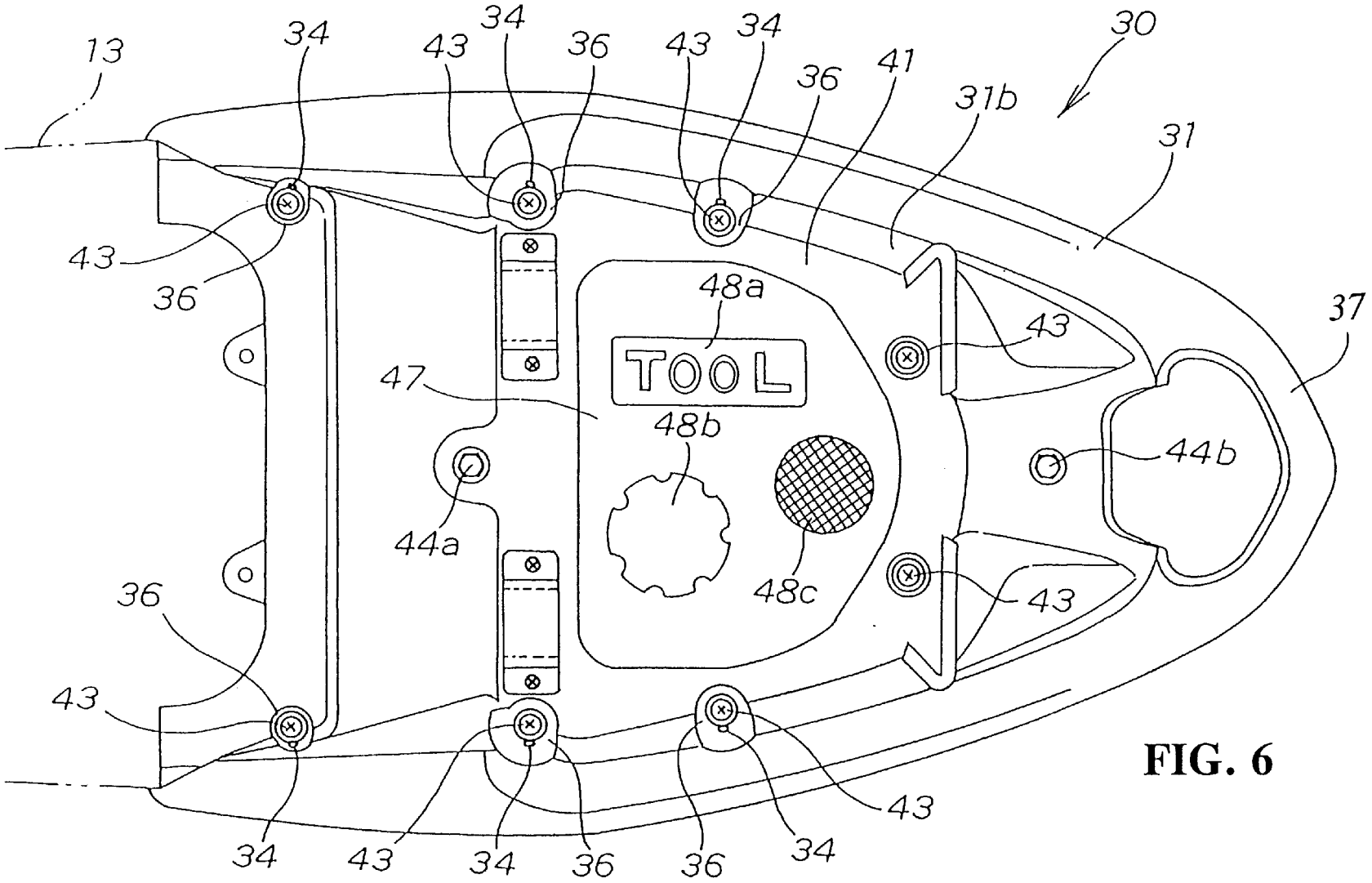
FIG. 6 is a plan view of the rear grip structure for a small boat according to the present invention.

FIG. 6 is a plan view of a rear grip structure for a small boat according to the present invention, showing a state in which the rear grip structure 30 is mounted on the upper hull 13 by providing a recess 41 inside the substantially U-shaped outer frame 31, forming the counterbores 36 . . . along the inner wall 31*b* of the outer frame 31, and inserting the mounting bolts 43 . . . into the bolt mounting holes (not shown) of the counterbores 36 . . . , and the second eyelets 34 . . . are formed respectively on the bottoms of the counterbores 36 . . . .

The reference numeral 37 is a grip portion integrally formed at the rear end of the outer frame 31. The occupant sitting on the rear seat can maintain a stable posture on the boat by laying his/her hand on the grip portion 37.

Figure 7:
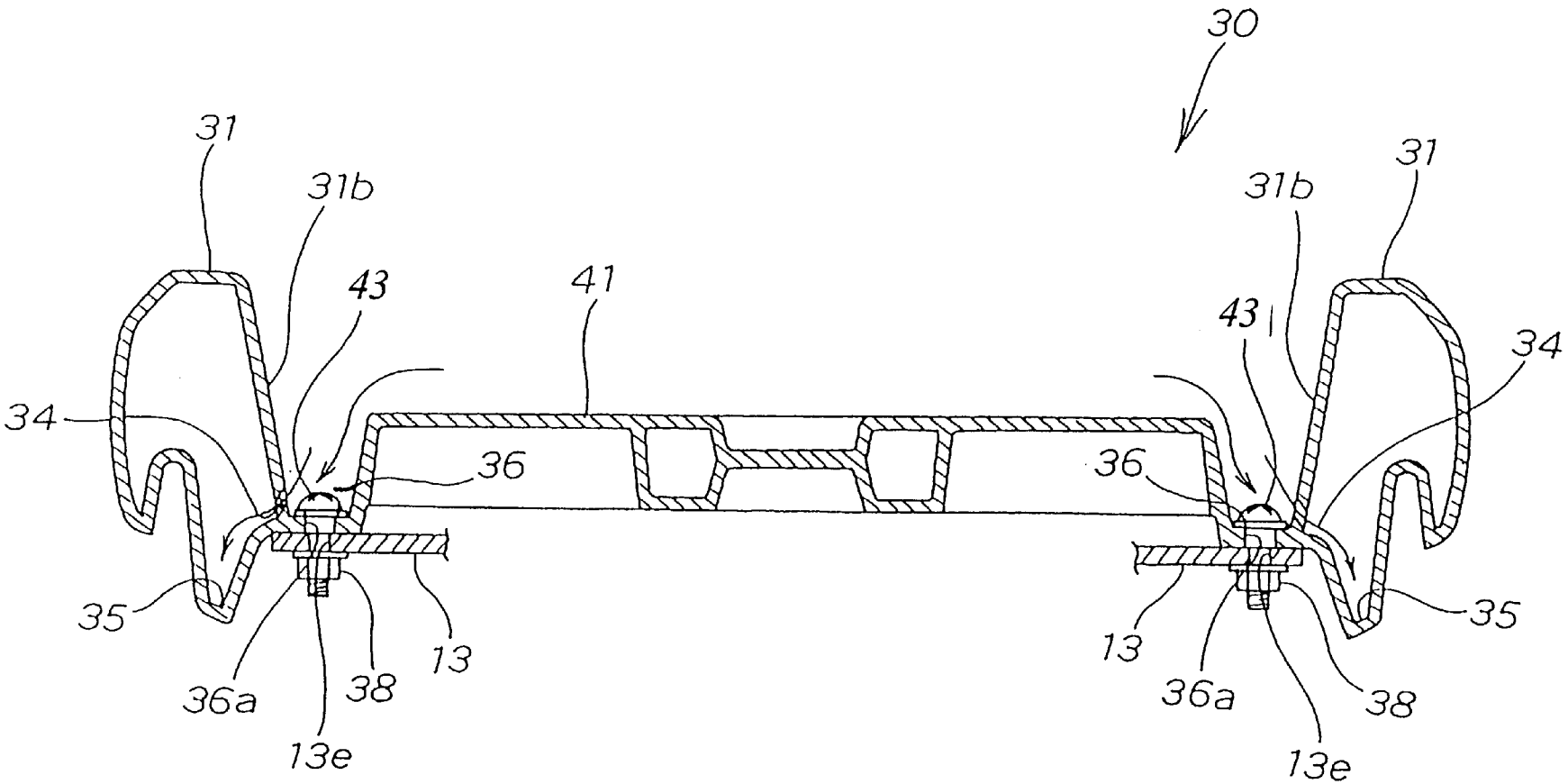
FIG. 7 is a cross sectional view taken along the line 7—7 in FIG. 5.

FIG. 7 is a cross sectional view taken along the line 7—7 in FIG. 5, showing a state in which the rear grip structure 30 is mounted on the upper hull 13 by forming counterbores 36 along the inner wall 31*b* of the substantially U-shaped outer frame 31. Mounting bolts 43 are inserted into the mounting holes 36*a* of the counterbores 36 and the mounting holes 13*c* of the upper hull 13, and nuts 38 are screwed onto the inserted bolts 43. Second eyelets 34 are formed on the bottom of the counterbores 36.

The second eyelets 34 are through holes formed from the counterbores 36 toward the hollow portion 35 so as to incline downward. By forming the second eyelets 34 so as to incline downward, seawater entering into the counterbores 36 flows smoothly into the hollow portion 35 of the outer frame 31 through the second eyelets 34 as shown by the arrow.

Figure 8B:
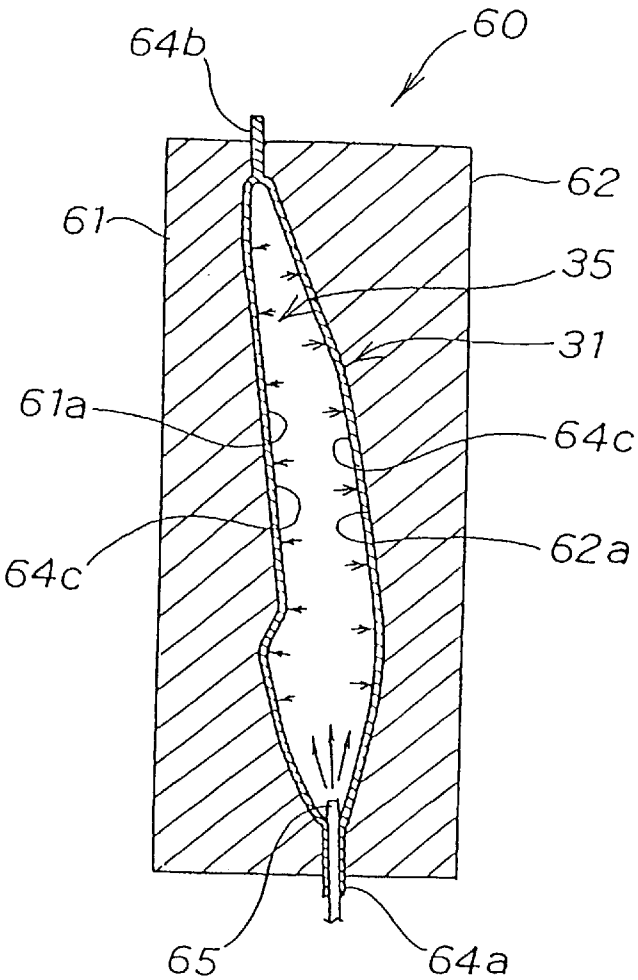
FIG. 8 is all explanatory drawing illustrating a method of blow molding the rear grip structure for a small boat according to the present invention.
Figure 8A:
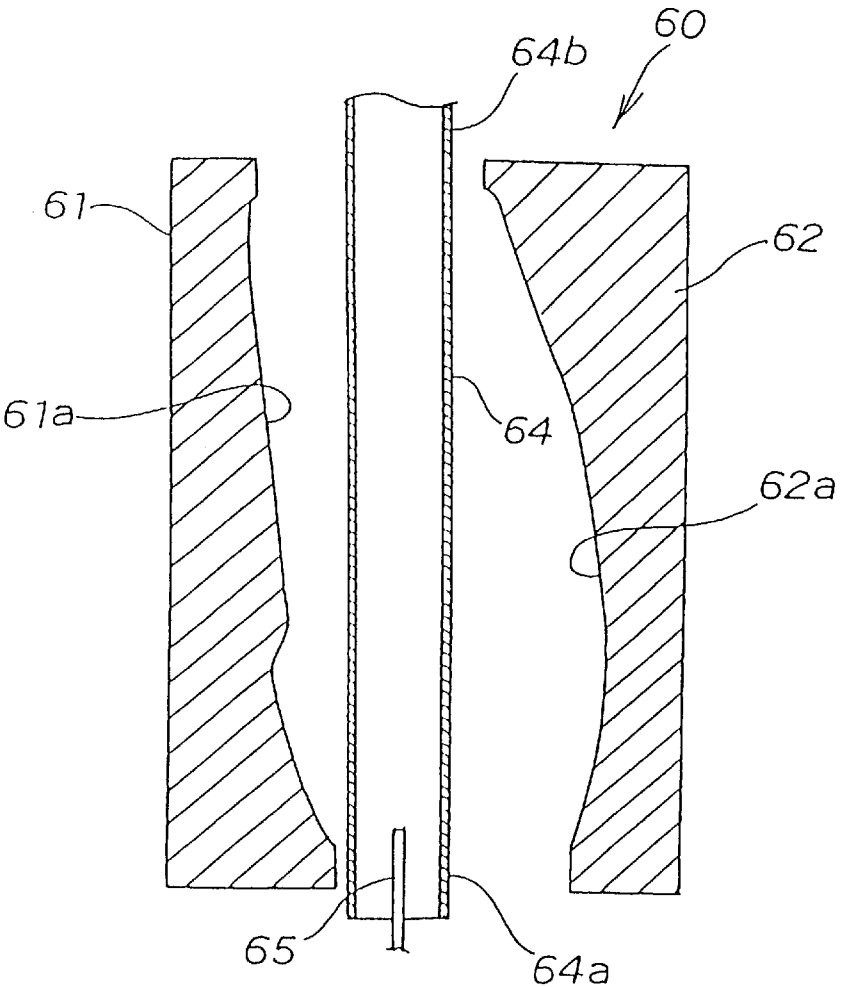

FIGS. 8A and 8B are explanatory drawings illustrating a method of blow molding of a rear grip structure for a small boat according to the present invention.

In the FIG. 8A, a resin parison 64 is hung between the respective dies 61, 62 with the blow molding die 60 is opened. A blowing nozzle 65 is provided inside the lower end portion 64*a* of the parison 64.

In the FIG. 8B, the upper and the lower ends 64*b*, 64*a* of the parison 64 are clamped by the respective dies 61, 62 by closing the blow molding die 60, and the upper end portion 64*b* of the parison 64 is cut.

Then, a prescribed air pressure is exerted on the inner wall 64*c* of the parison 64 as shown by the arrow by pressurizing the interior of the parison 64 by injecting air from the blowing nozzle 65 as shown by the arrow.

The hollow portion 35 is formed in the outer frame 31 by pressing the parison 64 against the molding surfaces 61*a*, 62*a* of the respective dies 61, 62 by the air pressure.

The hollow portion 35 of the outer frame 31 can easily be formed by blow molding the rear grip structure 30 as described above. Therefore, since the rear grip structure 30 can be blow molded without much time and effort, the cost of the rear grip structure 30 can be suppressed.

Figure 9A:
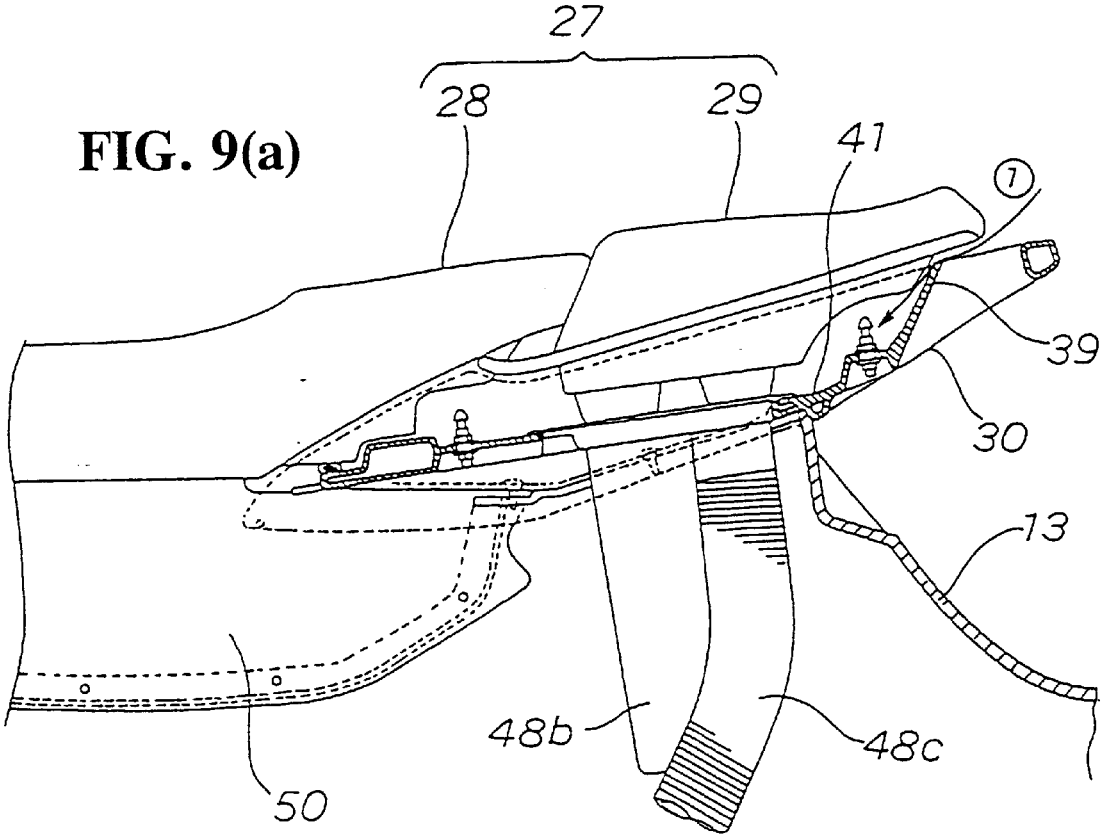
FIG. 9 is a first explanatory drawing illustrating the operation of a rear grip structure for a small boat according to the present invention.
Figure 9B:
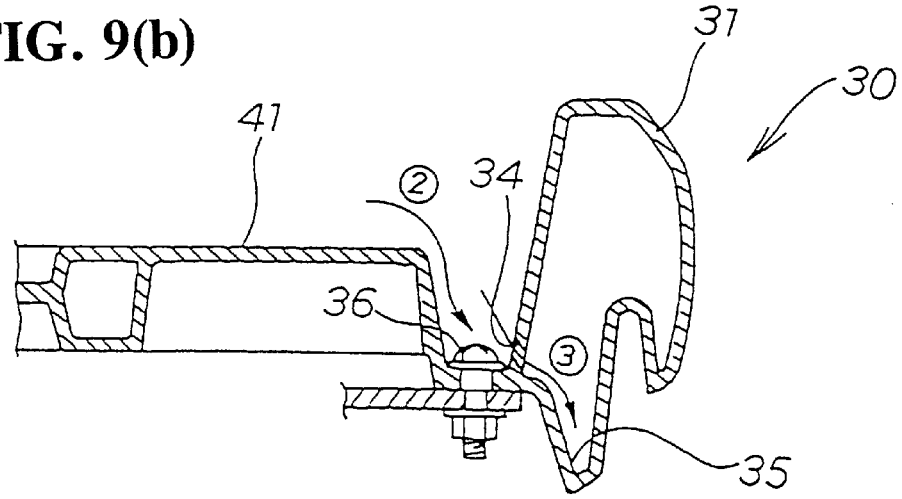
Figure 10:
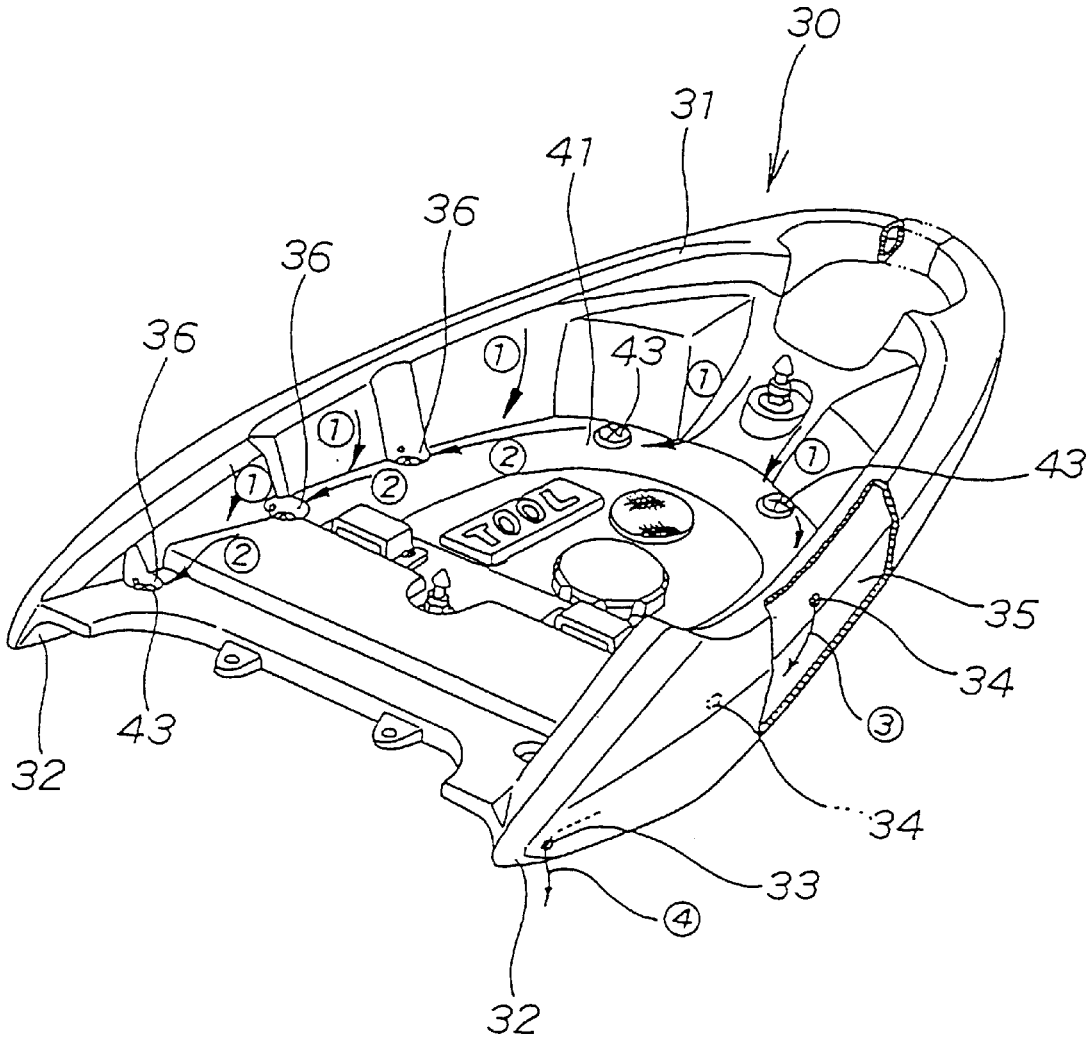
FIG. 10 is a second explanatory drawing illustrating the operation of a rear grip structure for a small boat according to the present invention.
Figure 11:
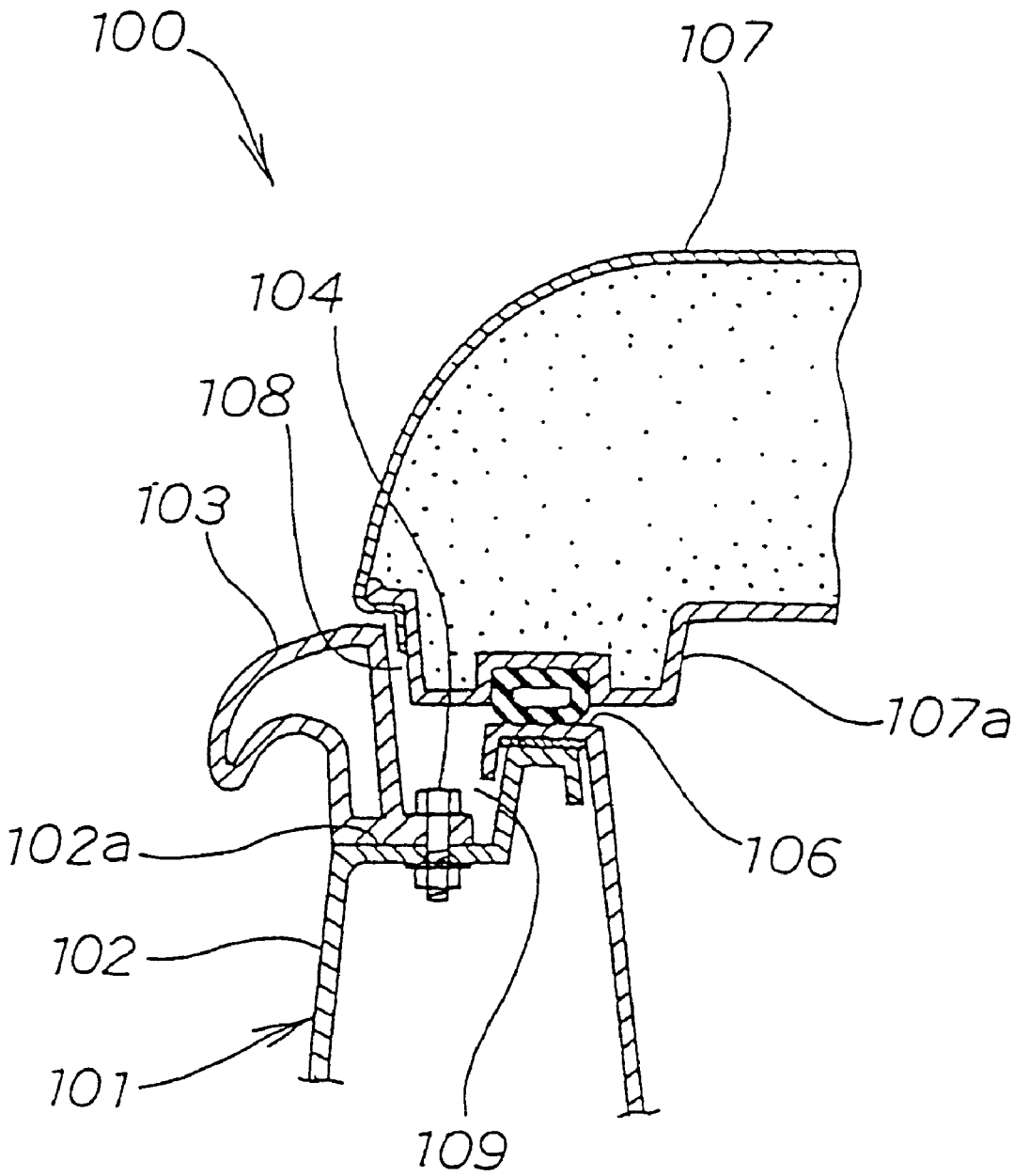
FIG. 11 BACKGROUND ART
FIG. 11 is a cross sectional view of a principal portion of the jet propulsion boat in the related art.

Referring now to FIG. 9 and FIG. 10, the operation of the rear grip structure for a small boat will be described.

FIGS. 9A and 9B are first explanatory drawings illustrating the operation of the rear grip structure for a small boat according to the present invention.

As shown in the FIG. 9A, seawater enters into the recess 41 of the rear grip structure 30 through the gap between the rear seat 29 of the saddle-riding type seat 27 and the rear grip structure 30 as shown by the arrow (1).

As shown in the FIG. 9B, seawater in the recess 41 of the rear grip structure 30 enters into the counterbore 36 as shown by the arrow (2). Seawater in the counterbore 36 flows into the hollow portion 35 of the outer frame 31 through the second eyelet 34 as shown by the arrow (3).

FIG. 10 is a second explanatory drawing illustrating the operation of the rear grip structure for a small boat according to the present invention.

In this figure, a flow of seawater will be described while repeating a part of description in conjunction with FIG. 9. Seawater enters into the recess 41 of the rear grip structure 30 through the gap 39 between the rear seat 29 of the saddle-riding type seat 27 and the rear grip structure 30 as shown by the arrow (1), as described in conjunction with FIG. 9A.

Seawater in the recess 41 of the rear grip structure 30 enters into the respective counterbores 36 . . . as shown by the arrow (2).

Seawater in the counterbores 36 then flows into the hollow portion 35 of the outer frame 31 through the respective second eyelets 34 . . . as shown by the arrow (3). Once in the hollow portion 35 the seawater flows to the lower portions 32, 32 of the outer frame 31 through the hollow portion, and then flows out of the outer frame 31 through the first eyelets 33, 33 (the one on the far side is not shown) as shown by the arrow (4). Therefore, seawater is prevented from collecting in the respective counterbores 36 . . . .

As described above, even when seawater enters the boat from between the rear grip structure 30 and the rear seat 29 of the saddle-riding type seat 27, it is taken into the hollow portion 35 of the outer frame 31 through the second eyelets 34 . . . and then flows down in the hollow portion 35 of the outer frame 31. Finally, the seawater is discharged to the outside of the outer frame 31 through the first eyelets 33, 33.

Therefore, seawater entering the boat between the rear grip structure 30 and the rear seat 29 of the saddle-riding type seat 27 can be discharged easily with little time and effort.

Though an example in which the rear grip structure 30 is manufactured by blow molding has been described in the aforementioned embodiment, it is not limited thereto, and is possible to manufacture in other manufacturing methods.

The outer frame 31 of the rear grip structure 30 and the recess 41 are not limited to the configuration shown in the embodiment, and it is possible to modify according to the configuration of a small boat as needed.

Furthermore, though a Jet propulsion boat which is propelled by a jet pump is exemplified for description as a small boat, the propelling means for a small boat is not limited thereto.

The present invention thus constructed exercises the following effects.

According to the invention, the hollow rear grip is inclined upward, and formed with first eyelets at the lower portions thereof and with second eyelets at the position higher than the first eyelets as needed. Accordingly, the rear grip plays the role of a drain trough.

Accordingly, even when water enters the boat from between the rear grip and the saddle-riding type seat, water is taken into the hollow rear grip through the second eyelets and then flows down in the rear grip and is discharged through the first eyelets to the outside.

Therefore, water entering the boat from between the rear grip and the saddle-riding type seat can be discharged easily without much time and effort.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rear grip structure for a boat comprising:

an engine disposed in substantially a center of a hull including an upper hull and a lower hull;

an opening formed on the upper hull above the engine;

a rear grip mounted on the upper hull and extending obliquely and rearwardly from the opening, the rear grip having a hollow portion which is capable of serving as a drain trough; and an elongated saddle-riding type seat placed over the opening and the rear grip, wherein the rear grip is formed with at least one first eyelet at a lower portion thereof and at least one second eyelet at a portion higher than the at least one first eyelet, and wherein water collecting on the rear grip is taken in via the at least one second eyelet and flows into the hollow portion, said water in the hollow portion then flows down and drains out through the at least one first eyelet.

2. The rear grip structure according to claim 1, further comprising a grip portion integrally formed on the rear grip.

3. The rear grip structure according to claim 1, wherein the rear grip is substantially U-shaped.

4. The rear grip structure according to claim 1, wherein said at least one first eyelet is a discharge hole penetrating an outer wall of the lower portion.

5. The rear grip structure according to claim 1, further comprising a recess portion formed in the rear grip, a bottom surface of the recess portion being fixed to the upper hull by a plurality of mounting bolts.

6. The rear grip structure according to claim 5, wherein the rear grip is formed with a plurality of counterbores and each of the plurality of mounting bolts is set within one of the counterbores.

7. The rear grip structure according to claim 6, wherein the at least one second eyelet is formed in at least one of the counterbores.

8. The rear grip structure according to claim 7, wherein the at least one second eyelet is formed inclining downward from the at least one of the counterbores and into the hollow portion of the rear grip.

9. A rear grip structure for a boat comprising:

an opening formed on an upper hull of the boat;

a rear grip mounted on the upper hull and extending obliquely and rearwardly from the opening, the rear grip having a hollow portion which is capable of serving as a drain trough; and an elongated saddle-riding seat placed over the opening and the rear grip, wherein the rear grip is formed with a first eyelet at a lower portion thereof and a second eyelet at a portion higher than the first eyelet, and wherein water collecting on the rear grip is taken in via the second eyelet and flows into the hollow portion, and said water in the hollow portion flows down and drains out through the first eyelet.

10. The rear grip structure according to claim 9, further comprising a grip portion integrally formed on the rear grip.

11. The rear grip structure according to claim 9, wherein the rear grip is substantially U-shaped.

12. The rear grip structure according to claim 9, wherein the first eyelet is a discharge hole penetrating an outer wall of the lower portion.

13. The rear grip structure according to claim 9, further comprising a recess portion formed in the rear grip, a bottom surface of the recess portion being fixed to the upper hull by a plurality of mounting bolts.

14. The rear grip structure according to claim 13, wherein the rear grip is formed with a plurality of counterbores, and each of the plurality of mounting bolts is set within each of the counterbores.

15. The rear grip structure according to claim 14, wherein the second eyelet is formed in at least one of the counterbores.

16. The rear grip structure according to claim 15, wherein the second eyelet is formed inclining downward from the at least one of the counterbores and into the hollow portion of the rear grip.

* * * * *